US009757724B2

(12) United States Patent
Rothacher et al.

(10) Patent No.: US 9,757,724 B2
(45) Date of Patent: Sep. 12, 2017

(54) APPARATUS FOR HERMETICALLY SEALED STORAGE OF LIQUIDS FOR A MICROFLUIDIC SYSTEM

(75) Inventors: Peter Rothacher, Bruchsal (DE); Christian Dorrer, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 619 days.

(21) Appl. No.: 13/985,784

(22) PCT Filed: Dec. 28, 2011

(86) PCT No.: PCT/EP2011/074170

§ 371 (c)(1),
(2), (4) Date: Oct. 28, 2013

(87) PCT Pub. No.: WO2012/110159

PCT Pub. Date: Aug. 23, 2012

(65) Prior Publication Data

US 2014/0045275 A1 Feb. 13, 2014

(30) Foreign Application Priority Data

Feb. 15, 2011 (DE) ..... 10 2011 004 125

(51) Int. Cl.
*B01L 3/00* (2006.01)

(52) U.S. Cl.
CPC ..... *B01L 3/5027* (2013.01); *B01L 3/502715* (2013.01); *B01L 3/502738* (2013.01); *B01L 3/523* (2013.01); *B01L 3/563* (2013.01); *B01L 3/565* (2013.01); *B01L 2200/16* (2013.01); *B01L 2300/0672* (2013.01); *B01L 2400/0683* (2013.01); *Y10T 436/2575* (2015.01)

(58) Field of Classification Search
CPC ..... B01L 3/5027; B01L 2200/0689
USPC ..... 436/180
See application file for complete search history.

(56) References Cited

U.S. PATENT DOCUMENTS

| | | | | |
|---|---|---|---|---|
| 2002/0047003 | A1* | 4/2002 | Bedingham | B01L 3/5025 219/388 |
| 2005/0196855 | A1 | 9/2005 | Gau et al. | |
| 2007/0166192 | A1 | 7/2007 | Ehben et al. | |
| 2007/0264629 | A1* | 11/2007 | Holmes | B01L 3/5027 435/5 |

(Continued)

FOREIGN PATENT DOCUMENTS

| | | | |
|---|---|---|---|
| CN | 201041563 | Y | 3/2008 |
| CN | 101176001 | A | 5/2008 |
| DE | 10 2007 046 951 | B3 | 2/2009 |

(Continued)

OTHER PUBLICATIONS

International Search Report corresponding to PCT Application No. PCT/EP2011/074170, mailed May 16, 2012 (German and English language document) (7 pages).

*Primary Examiner* — Christine T Mui
*Assistant Examiner* — Emily Berkeley
(74) *Attorney, Agent, or Firm* — Maginot, Moore & Beck LLP

(57) ABSTRACT

An apparatus for hermetically sealed storage of liquids for a microfluidic system includes at least one cavity and at least one sealing cone. A connection to the microfluidic system is established via the at least one sealing cone. Additionally, the at least one sealing cone is configured to close the at least one cavity.

20 Claims, 5 Drawing Sheets

(56) References Cited

U.S. PATENT DOCUMENTS

2008/0041738 A1 2/2008 O'Donnell et al.

FOREIGN PATENT DOCUMENTS

| | | | | |
|---|---|---|---|---|
| DE | 10 2008 042 054 | A1 | 3/2010 | |
| EP | 2 087 934 | A1 | 8/2009 | |
| EP | 2 230 015 | A1 | 9/2010 | |
| WO | 2006/053588 | A1 | 5/2006 | |
| WO | 2006/079082 | A2 | 7/2006 | |
| WO | WO 2006079082 | A2 * | 7/2006 | ..... B01L 3/502707 |
| WO | 2008/076395 | A2 | 6/2008 | |
| WO | 2009/146088 | A1 | 12/2009 | |

* cited by examiner

APPARATUS FOR HERMETICALLY SEALED STORAGE OF LIQUIDS FOR A MICROFLUIDIC SYSTEM

This application is a 35 U.S.C. §371 National Stage Application of PCT/EP2011/074170, filed on Dec. 28, 2011, which claims the benefit of priority to Serial No. DE 10 2011 004 125.7, filed on Feb. 15, 2011 in Germany, the disclosures of which are incorporated herein by reference in their entirety.

BACKGROUND

In microfluidic systems, e.g. lab-on-chip (LOC) systems, it is necessary to convey the biochemical reagents and the sample onto/into the chip. In contrast to simple lateral-flow test strips, e.g. for immunological detection methods, several reagents are often needed in the chip system for molecular diagnostic tests. On-chip storage in dried form, for example lyophilized form, which is easy to handle and user-friendly, is not always possible here. Another important difference between most molecular diagnostic tests and lateral-flow test strips is that it is often necessary to handle large amounts of analyte solutions or wash solutions which, because of their large volume of up to several milliliters, are difficult to integrate on the chip.

To meet these requirements, storage vessels external to the chip are used for example, with external syringe pumps and connections to the chip. Alternatively, the reagents are introduced into the storage containers or reaction chambers of the chip manually. While the first variant can easily lead to contamination or air in the syringe pumps, the second variant is associated especially with the problem of operating errors by the users. Moreover, systems in which fluids are added by means of compressed air also known, but the volumes that can be added are reproducible only with difficulty, and compressed air can get into the fluidic system.

For these reasons, systems have been developed in which the reagents are stored directly in an integrated manner on the chip. For this purpose, WO 2006053588 describes a device for use in a microfluidic system, in which a liquid is stored in a blister reservoir. After the blister has been brought into contact with the microfluidic system, a film between the blister reservoir and the microfluidic system is pierced, such that a fluid connection is obtained between the blister reservoir and the microfluidic system. The liquid is then brought into a channel of the microfluidic system by applying manual pressure to the blister reservoir. To ensure that film between the blister reservoir and the microfluidic system is not pierced too early, the system of blister reservoir and microfluidic system comprises a special holding device.

A further device is disclosed in WO 2008076395. In this device, a plurality of blister reservoirs are brought into direct contact with the microfluidic system, and opened by needles, only at the moment when the liquids stored in them are to be used. In addition, by alternate compression of the blister reservoirs, the system allows individual substances to be mixed in the microfluidic system.

SUMMARY

The subject of the present disclosure is a device for hermetically sealed storage of liquids for a microfluidic system, having at least one cavity for receiving a fluid, and at least one sealing cone via which a fluidic connection to the microfluidic system can be established.

In the text below, "hermetically sealed storage of liquids" is understood as meaning that liquids already contained in the device, or introduced into the device by the user, are stored until such time as they are used in a microfluidic system, the storage being completely tight and sealed off from the outside, such that no contaminants are able to enter.

A "microfluidic system" is a miniaturized fluid system. This includes, for example, micro-total analysis systems (μTAS) or LOC systems. They have the advantage that individual work steps are combined and automated and at the same time reduced to a micro scale. The potential of such systems lies especially in the possibility of automation, in the rapid reaction times, and in the reduced volumes of sample and reagents, such that an analysis laboratory in the form of a miniaturized system is made possible. The fluids are preferably reagents, samples, analytes and/or solvents. In the LOC systems, the chip for analysis is inserted or placed in a laboratory apparatus. The device according to the disclosure, with the necessary fluids, is either integrated into the LOC system and connected fixedly thereto or is stored separately from the LOC system and connected fixedly to the LOC system only during operation.

The expression "cavity for receiving a fluid" designates hereinbelow a chamber which is defined by outer boundaries and which is suitable for receiving liquids. In a preferred embodiment, the at least one cavity is formed from at least two parts that are connected to each other, preferably welded or adhesively bonded to each other, in partial surfaces, wherein the parts are chosen from the group comprising polymer film, polymer sheet, and elastomeric membrane.

In a variant of this embodiment, the cavity is composed of two polymer sheets which are structured by means of injection molding, milling, thermoforming or hot stamping for example, and which can be connected to each other by welding or adhesive bonding, for example.

In a further variant of this embodiment, the at least one cavity is formed from at least two thermoformed polymer films or sheets that are welded or adhesively bonded to each other in partial surfaces, such that, between the unconnected partial regions, cavities form that are suitable for receiving the fluids. Materials that can be considered are, in particular, suitable plastics which are thermoformed or pressed.

In a third variant of this embodiment, the cavity is delimited by an elastomeric membrane which in subsidiary regions is connected, e.g. welded or adhesively bonded, to a polymer film or polymer sheet, such that, between the unconnected subsidiary regions, cavities form that are suitable for receiving the fluids. This has the effect that the elastomeric membrane, in the unfilled state, rests on the polymer film or polymer sheet. This embodiment has the advantage that no venting opening is needed, since the elastomeric membrane inflates during filling, and it contracts again while liquid is being introduced into the microfluidic system. The connection to the microfluidic system may also optionally be established via the elastomeric membrane.

Alternatively, a one-piece structure is also possible, e.g. as a thermoformed shaped plastic part.

As regards the choice of materials, care must be taken in particular to ensure that they are inert to the fluids that are to be stored in them. Examples of materials that can be used are thermoplastics, for example polystyrene, polycarbonate, polyethylene, polypropylene, polymethyl (meth)acrylate, cyclic olefin copolymers or cyclic olefin polymers. In this context, it is a further decisive advantage of the device according to the disclosure that it can be produced as a disposable article.

Generally, the cavities lying therebetween have a volume of 10 μl to 10 ml, preferably of 20 μl to 5 ml, particularly preferably of 200 μl to 1 ml, wherein the end values of the ranges, and all the individual values between these, are included. The main surface of the cavity can be circular, oval or rectangular, for example. Alternatively, the cavity can also be configured as a channel, i.e. much longer than it is wide and high, e.g. as a meandering channel. This embodiment has the advantage that, when filling or emptying is driven by pressure, the inclusion of air bubbles or incomplete emptying is avoided.

In a further embodiment, the cavity additionally has a channel structure through which the fluids, e.g. reagents, solvents or venting gases, can flow. The channel structure has the advantage that, if so required, a metered addition of the fluids is possible, and there is greater flexibility as regards the positioning of the at least one sealing cone.

In a preferred embodiment, the at least one cavity is formed as a blister structure, i.e. it has a bubble shape. Blisters have the advantage that they can be produced inexpensively, e.g. from thermoplastics, and their flexibility allows the fluids to be pressed out of them. Moreover, the use of a blister has the advantage that no venting opening is needed, since the blister collapses in on itself while the liquid is being dispensed into a microfluidic system. A combination of both structures is also possible, i.e. a bubble-shaped reservoir and a channel adjoining it.

It is of course possible that the device has more than one cavity in order to receive various fluids. In a preferred embodiment, the device has at least one cavity for receiving reagents in the form of a fluid.

In another embodiment, the device has at least one cavity in which a sample that is to be analyzed is received as fluid. A device with at least two cavities, i.e. one for receiving reagents and one for receiving a sample, is of course also possible.

In another embodiment, the device has at least one cavity as a waste reservoir. Alternatively, at least one cavity for receiving reagents, or at least one cavity in which a sample that is to be analyzed is received, is used as a waste reservoir after emptying into the microfluidic system. In the text below, the term "waste reservoir" designates a collecting device for already used fluids from the microfluidic system. This has the advantage that media that have been used can be safely stored without contaminating the system. Moreover, it is thus possible to dispense with additional external waste reservoirs, and, in the case of a disposable article, the latter can be disposed of easily and safely together with the device according to the disclosure. If the device has more than one cavity, any desired number of them can serve as waste reservoirs. In this case, it is also possible for the device to comprise a cavity that is not filled at the outset with liquid and that serves later as a waste reservoir.

In most cases, the cavity initially filled with reagents, sample or solvent will serve as a waste reservoir only when the fluid has escaped from the cavity after the connection to the microfluidic system has been established. However, it is also conceivable that the fluid located in the cavity has special properties that are critical to the use of the cavity as a waste reservoir, e.g. a disinfecting agent. If the cavity is used from the start as a waste reservoir, in a preferred embodiment the waste reservoir can contain an absorption material, preferably a superabsorber, or superabsorbent particles or fibers, such that nothing can escape from the device in the event of waste fluid flowing back. This is advantageous in particular if the device is oriented vertically during use and the waste reservoir is filled from below.

In one embodiment, the at least one cavity has a venting opening, preferably a venting channel. In this way, air can flow in when the fluid is being emptied from the cavity and, conversely, the air or other gases contained in the cavity can escape when the latter is being filled. However, during the storage of the device, the venting opening is closed, such that no fluid can escape and no contaminants can enter from outside. In the simplest case, this venting opening is composed only of superposed film areas not welded in this area. As long as the device is held vertically, air can escape through the intermediate gap, but fluids cannot. It is thus possible to prevent the contamination of further system components such as the laboratory apparatus or connecting hoses.

In another embodiment, the capillary venting channel is closed after the cavity has been filled, e.g. closed by welding, clamping, or with an adhesive film, such that an escape or a contamination of the liquid during storage and during operation is avoided in a particularly reliable way.

In another embodiment, the venting opening is closed by a sealing cone. In this case, a fluid connection to the microfluidic system is established by opening the sealing cone, and the ventilation takes place through the microfluidic system. This embodiment also has the advantage that an escape or a contamination of the liquid during storage is avoided particularly reliably. In addition, this embodiment has the advantage that the venting opening can be opened at the same time as the other fluidic connections, as a result of which the handling is simplified.

It is also conceivable that the device has one or more cavities that are designed as blisters and do not require venting openings and also comprises one or more cavities that are not designed as blisters and may require venting openings, e.g. if they serve as a waste reservoir.

In another embodiment, the at least one cavity of the device has a filling opening, preferably a funnel-shaped filling nozzle. The sample to be analyzed, for example, can be introduced by the user via the filling opening, while further cavities without filling opening contain pre-loaded reagents. In diagnostic tests, the sample can be, for example, blood, sputum, urine, plasma, serum, wash solutions, or secretions. The sample can be introduced into the filling opening with the aid of syringes or micro-pipets. Filling and venting openings are then closed. For this purpose, use is preferably made of automatic welding appliances, stoppers, seals, clamps or adhesive films.

The term "sealing cone" hereinbelow designates a component via which a fluidic connection can be established between the at least one cavity and the microfluidic system. Moreover, the sealing cone serves to close the at least one cavity. Generally, the cavity can also be closed at other places by further means, e.g. by a cover or the like. In the simplest configuration, however, the cavity is filled and also emptied only via the sealing cone. The hermetically sealed storage is therefore obtained only through the closing and opening of the sealing cone. Depending on the functionality of the fluid and on the number of cavities, the device also has a plurality of sealing cones.

By opening the sealing cone, a fluidic connection is created between the at least one cavity of the device and a microfluidic system, such that the passage of liquid is enabled. The connection is at the same time fluid-tight, i.e. there is no possibility of unwanted escape of liquid from the connection between the cavity and the microfluidic system.

In a preferred embodiment, the sealing cone comprises at least one of the following components via which a connection between the sealing cone and the microfluidic system can be established: predetermined breaking point, pin, elastomeric seal and/or film.

The term "predetermined breaking point" designates hereinbelow a safety element which is designed such that it deliberately breaks under mechanical loading, and a connection is thus established. By using a pin, in particular in combination with a predetermined breaking point, pressure is exerted on the sealing cone by pressing the pin inward, until the sealing cone yields and a connection is enabled between the device and the microfluidic system. Alternatively, the pin can also be integrated in the microfluidic system and, like a key, can lead to the sealing cone being opened as a result of the device being pressed onto the microfluidic system. Elastomeric seals are elastically deformable plastic seals which elastically deform under tensile loading and compressive loading and which return to their original shape after the load subsides. Specifically, the elastomeric seal can be designed as a sealing film. The latter has the advantage that, after the connection to a channel of the microfluidic system has been established, it closes again as soon as the device is separated from the microfluidic system.

The sealing cone can have a variety of shapes. For example, the shapes of the sealing cone are determined according to the shape of the attachment site of the microfluidic system, in order to ensure that the connection between the device and the microfluidic system is as leak-tight as possible. The sealing cone preferably fits like a key into the attachment site of the microfluidic system, which forms the associated lock.

When opening the sealing cones, it is possible to open several sealing cones simultaneously by pressing on one point, e.g. if these sealing cones lie one above another or are sequentially connected to one another and are opened via a pressure point. Conversely, it is possible, by pressing on one sealing cone, that liquid can emerge from several cavities, since all of the cavities are closed by the same sealing cone. This is particularly advantageous if fluids from different cavities, e.g. sample and buffer solution, are to be mixed with one another. In another variant, several cavities can be opened one after another by sequentially pressing on several sealing cones.

In a particular embodiment, the device has a plurality of cavities arranged as on a punched card. Thus, for example, a roller that travels across the device can press the cavities out in a predetermined sequence. The traveling roller is therefore akin to a hose pump. Moreover, the volumetric flow in the microfluidic system can be controlled by the speed of the roller and by the cross section of the cavities in the device.

However, it is also possible that a slight overpressure prevails in the cavity. This has the advantage that, after a connection to the microfluidic system has been established, the liquid leaves the cavity more quickly via the sealing cone, and no additional pressure has to be applied to the cavity.

Of course, these different possibilities can also be combined in any desired manner.

By using a sealing cone, it has surprisingly been found that the device according to the disclosure ensures safer storage of the fluids and simpler handling, since it is possible to dispense with highly pressure-sensitive connecting materials such as thin films and, depending on the design, it may also be possible to dispense with the use of needles or spikes, etc., for opening the sealing cone. In addition, fewer components are used than is the case in the presently known devices. Furthermore, the sealing cone serves as an adjustment aid when placing and arranging the device on a microfluidic system, since the sealing cone is inserted with an exact fit into the system.

Until such time as the liquid is used, the device is stored together with or separate from the microfluidic system. If the device is stored together with the microfluidic system, it is already arranged on the microfluidic system and is connected fixedly and irreversibly thereto, if appropriate also flexibly with some play between them. Various techniques are conceivable for establishing the connection, for example welding, bonding, lamination, double-sided adhesive tape, or gluing with intermediate layers of elastic materials, e.g. foamed rubber or an elastomer. However, in this case too, the liquid in the device is always separated from the microfluidic system by the sealing cone, which is opened only during operation. Separate storage is understood as the device being kept separate from the microfluidic system, e.g. as a separate part of a kit. In this case, the two components are connected directly before or during insertion into the laboratory apparatus, e.g. by adhesive bonding, clamping or superpositioning.

In a further aspect, the present disclosure relates to the use of the above-described device in a microfluidic system. This use involves the following steps:

a) providing a device as described above,
b) filling the at least one cavity with a fluid,
c) closing the at least one cavity, and
d) establishing a fluidic connection between the device and the microfluidic system via the sealing cone of the device.

As has already been described, a corresponding device for storing liquids is provided and filled. Step b), for example in respect of reagents, can directly follow the production of the device or, in respect of the sample to be analyzed, can also be done at least in part by the user. This applies in the same way to step c).

In step d), a connection between the device according to the disclosure and the microfluidic system is established by opening the sealing cone. The sealing cone can be opened, for example, by manually placing the device and the microfluidic system on each other and then pressing them together, such that the device opens when they are pressed together. Alternatively, the opening also takes place as an automated step and is accordingly performed automatically in a laboratory apparatus. Alternatively, when the device and the microfluidic system are placed one on top of the other, a locking action can occur. In a preferred embodiment, the sealing cone in step d) is opened by pressing against a mechanical resistance on the microfluidic system or with the aid of a spike or a needle in the microfluidic system. Alternatively, the spike or the needle can also be integrated in the device for storing the liquids. If step d) is automated, the opening can be effected by the laboratory apparatus, in which case the pressing action is provided by a mechanical actuator, e.g. an electric or pneumatic linear actuator.

Preferred embodiments of needles have, at their tip, a notch, a hole with a transverse bore, or openings which ensure that, in the pierced opening of the sealing cone, an opening remains free for the liquid. At the same time, however, the needle has to be designed such that a reliable seal is obtained between needle and microfluidic system and between needle and device, comparable to a seal provided by a septum. Preferably, the at least one needle or the at least one spike is arranged such that the sealing cone cannot open prematurely during the joint storage of the device along with the microfluidic system. This is achieved, for example, by separate storage of the needle. The arrangement of the needle or of the spike on the microfluidic system, or alternatively on the device itself, is of course such that there is no risk of injury to the user.

In a further embodiment, the microfluidic system has an elastomeric sealing membrane which, together with the sealing cone of the device, is opened in step d) in order to establish the fluidic connection. The elastomeric seal generally lies on that side of the microfluidic system opposite the sealing cone.

In any case, the use of the device according to the disclosure permits the controlled addition of stored liquid to a microfluidic system. Moreover, precise control of the volumes of liquid delivered to the system is possible up to several milliliters. For this purpose, after the connection to the microfluidic system has been established, the whole of the liquid stored in the cavity of the device is dispensed to the microfluidic system. This ensures that a predetermined amount of liquid is dispensed into the microfluidic system.

The liquid generally reaches the microfluidic system by gravity, by capillary forces and/or by a slight overpressure in the cavity. Alternatively or in addition, the liquid can be pressed out manually or mechanically, particularly when the device has a blister structure. In the simplest case, the cavity of the device is arranged over a channel of the microfluidic system, such that the liquid flows into the channel by gravity after the connection to the microfluidic system has been established. Alternatively, pressure can be applied to the cavity via a mechanical actuator contained in the laboratory apparatus, e.g. via an electric or pneumatic linear actuator. As a further alternative, particularly when using a blister structure, a pneumatic overpressure can be applied to the entire outside of the device. In a further variant, a pump, e.g. a peristaltic pump, is located in the interior of the microfluidic system and sucks the fluid out of the cavity.

BRIEF DESCRIPTION OF THE DRAWINGS

Further advantages and advantageous configurations of the device according to the disclosure and of the method according to the disclosure are set forth in the figures and in the illustrative embodiments and are explained in the description below. It should be noted that the figures and the illustrative embodiments are merely of a descriptive character and are not intended in any way to limit the disclosure.

DETAILED DESCRIPTION

Figure 1:
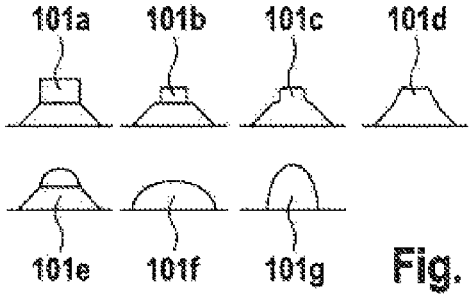
FIG. 1 shows schematic views of various embodiments of a sealing cone.

FIG. 1 shows schematic views of various embodiments of the sealing cone 101*a*-101*g*.

Figure 2A:
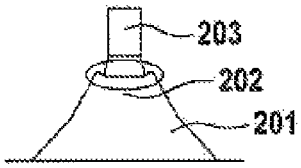
FIG. 2A shows a schematic view of a sealing cone, which comprises a predetermined breaking point and a pin.

FIG. 2A shows a schematic view of a sealing cone 201, which comprises a predetermined breaking point 202 and a pin 203.

Figure 2B:
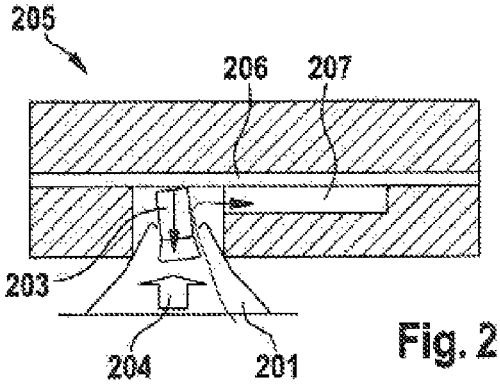
FIG. 2B shows the sealing cone of FIG. 2A with a microfluidic system, which has a sealing film and a channel.

FIG. 2B, in addition to showing a schematic view of the sealing cone 201 with a predetermined breaking point 202 and a pin 203, also shows a microfluidic system 205, which has a sealing film 206 and a channel 207. The sealing cone 201 is already arranged on the microfluidic system 205. The figure shows how, by applying a force (indicated by the arrow 204) to the sealing cone 201, the predetermined breaking point 202 is pressed inward by the pin 203, which strikes the film 206, such that a connection to the channel 207 of the microfluidic system 205 is established via the sealing cone.

Figure 3A:
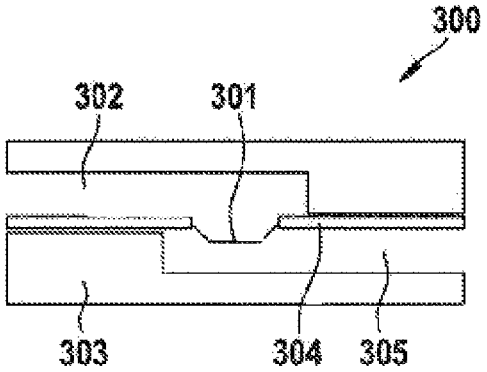
FIG. 3A shows a schematic view of a device for the storage of liquids for a microfluidic system having a cavity and a sealing cone.

FIG. 3A shows a schematic view of a device 300 for the storage of liquids for a microfluidic system 303, having a cavity 302, here designed as a channel, which is filled with liquid, and also a sealing cone 301, via which a connection to a channel 305 of the microfluidic system 303 can be established and which closes the cavity 302. The microfluidic system 303 comprises a sealing film 304. In this example, the device 300 is stored together with the microfluidic system 303, resulting in what is called a multi-layer structure. The figure does not show that, in this example, the cavity 302, designed as a channel and filled with liquid, is likewise closed at its end directed away from the cone.

Figure 3B:
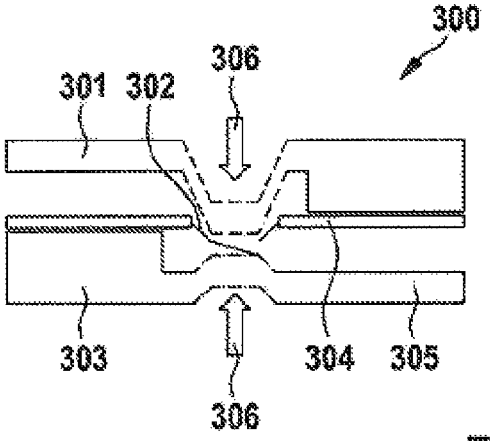
FIG. 3B shows a schematic view of how the sealing cone is opened and a connection is established to the channel of the microfluidic system by applying a force either to the device, the microfluidic system, or both.

FIG. 3B shows a schematic view of how, by applying a force 306 either to the device 300 or to the microfluidic system 303, or to both, the sealing cone 301 is opened and a connection is thus established to the channel 305 of the microfluidic system 303.

Figure 4A:
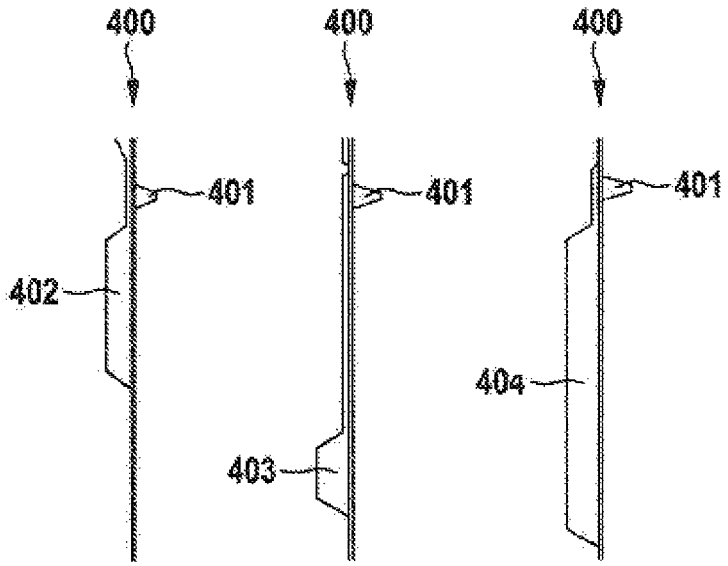
FIG. 4A shows three schematic views of a device that has three sealing cones and three cavities designed as blisters.

FIG. 4A shows three schematic views of the same device 400. The device comprises three sealing cones 401, and three cavities 402, 403 and 404 designed as blisters. Cavity 403 serves as a reservoir for reagents. Cavity 402 is a sample reservoir, and cavity 404 is a waste reservoir. A connection to a microfluidic system (not shown) can be established via the sealing cones 401.

Figure 4B:
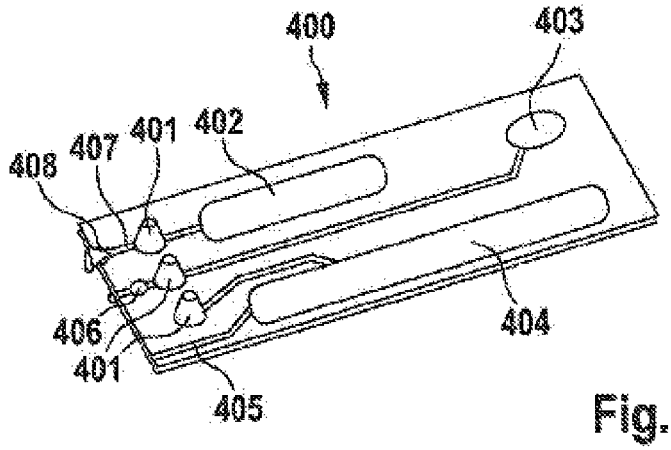
FIG. 4B shows a schematic view of the underside of the device of FIG. 4A.

FIG. 4B shows a schematic view of the underside of the device 400 from FIG. 4A, in which the liquid passes in the direction of gravity from the device into the microfluidic system (not shown). It will be seen from this view that, in addition to having the three sealing cones 401 and the three cavities 402, 403 and 404 designed as blisters, the device also comprises a venting channel 405 and a channel for filling 407. Moreover, the connection to cavity 403 is sealed by a mash weld 406. It can further be seen that the channel 407 for filling the sample reservoir 402 is closed by a stopper 408. The latter allows the reservoir to be filled with a sample and to be hermetically sealed before the device is arranged on the microfluidic system (not shown).

Figure 5A:
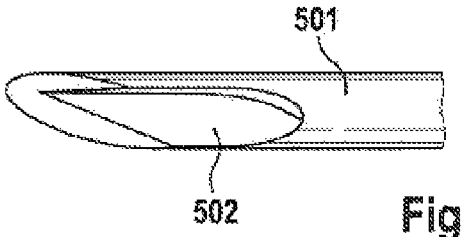
FIG. 5A shows a schematic view of a needle with a V-shaped notch.

FIG. 5A shows a schematic view of a needle 501 with a V-shaped notch 502.

Figure 5B:
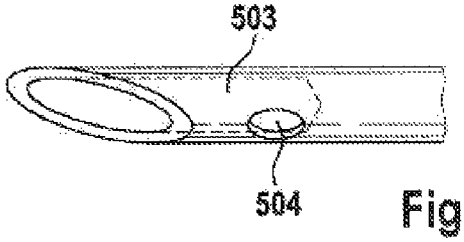
FIG. 5B shows a schematic view of a hollow needle with a transverse bore.

FIG. 5B shows a schematic view of a hollow needle 503 with a transverse bore 504.

These types of needles can be used, for example, to pierce the sealing cone and establish a connection between the at least one cavity of the device and the at least one channel of the microfluidic system.

Figure 6A:
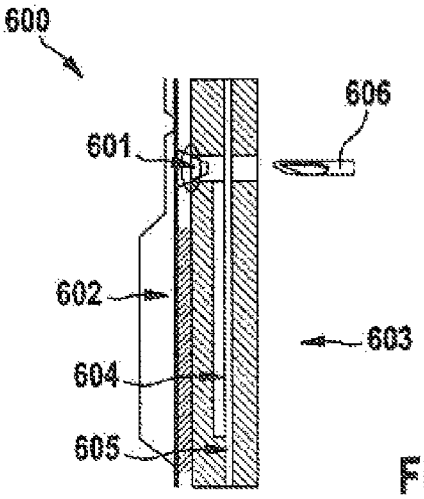
FIG. 6A shows a schematic view of a device that has a sealing cone and a cavity filled with liquid, a microfluidic system that has a channel and an elastomeric seal, and a needle with a V-shaped notch that is stored separately from the device.

FIG. 6A shows a schematic view of a device 600 comprising a sealing cone 601 and a cavity 602 filled with liquid, and also a microfluidic system 603 having a channel 604 and an elastomeric seal 605, here an elastomeric membrane. The figure also shows a needle 606 with a V-shaped notch, which needle has been stored separately from the device.

Figure 6B:
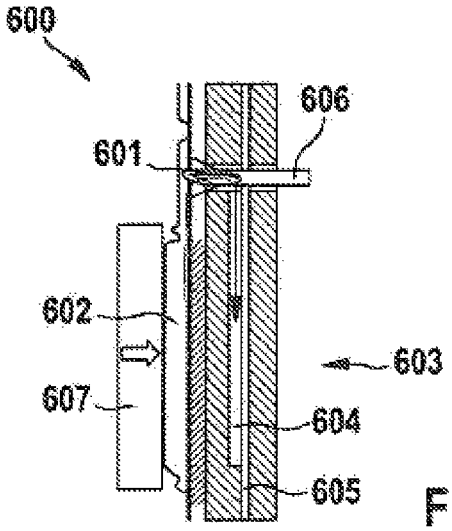
FIG. 6B shows a schematic view of how the needle with the V-shaped notch has pierced the sealing cone.

FIG. 6B shows a schematic view of how the needle 606 with the V-shaped notch has pierced the sealing cone 601 and how, as a result, a fluidic connection between the liquid-filled cavity 602 and the channel 604 of the microfluidic system 603 has been established via the sealing cone 601. The liquid is now pressed out of the cavity 602 with the aid of a force (indicated by the block arrow), which force is applied by a punch 607, for example.

Figure 7:
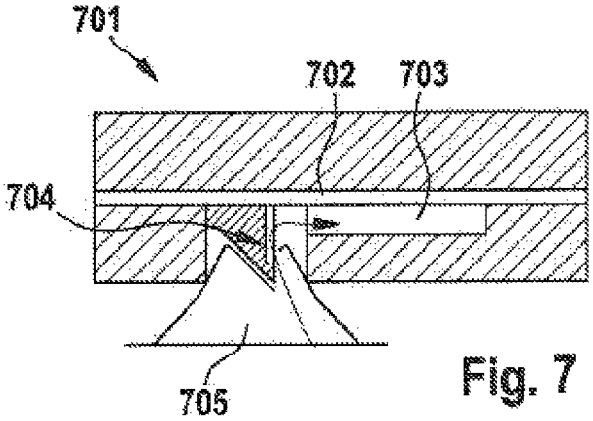
FIG. 7 shows a schematic view of a microfluidic system that has a sealing film, a channel, and a needle with an undercut.

FIG. 7 shows a schematic view of a microfluidic system 701 comprising a sealing film 702, a channel 703, and a needle 704 with an undercut. The needle with the undercut pierces the sealing cone 705 of the device when the latter is arranged on the microfluidic system 701.

The invention claimed is:

1. A device for hermetically sealed storage of liquids for a microfluidic system, comprising:

at least one cavity formed in the device, the at least one cavity being configured to receive a fluid; and at least one sealing cone, in a first configuration the at least one sealing cone being arranged between and separating the at least one cavity from a channel in the microfluidic system, and in a second configuration the at least one sealing cone providing a passage through the at least one sealing cone that fluidically connects the at least one cavity and the channel of the microfluidic system, wherein the at least one sealing cone is shaped as a protuberance.

2. The device as claimed in claim 1, wherein the at least one cavity has in its entirety, or in parts thereof, one or more of a channel structure and a blister structure.

3. The device as claimed in claim 1, wherein the at least one cavity is formed from at least two parts that are connected to each other in partial surfaces, and wherein the parts are chosen from the group comprising polymer film, polymer sheet, and elastomeric membrane.

4. The device as claimed in claim 1, wherein the at least one cavity has a volume of 10 μl to 10 ml.

5. The device as claimed in claim 1, wherein the at least one cavity is configured to receive reagents as fluid.

6. The device as claimed in claim 1, wherein the at least one cavity is configured to receive a sample that is to be analyzed as fluid.

7. The device as claimed in claim 1, wherein:

the at least one cavity serves as a waste reservoir after being emptied of the fluid.

8. The device as claimed in claim 7, wherein the waste reservoir contains an absorption material.

9. The device as claimed in claim 1, wherein the at least one cavity has a filling opening.

10. The device as claimed in claim 9, wherein the filling opening is closed by a stopper, a mash weld, a clip, a seal, or an adhesive tape.

11. The device as claimed in claim 1, wherein the at least one cavity has a venting opening.

12. The device as claimed in claim 1, wherein the sealing cone comprises at least one of the following components via which a connection is configured to be established between the sealing cone and the microfluidic system: a predetermined breaking point, a pin, an elastomeric seal, and film.

13. The device as claimed in claim 3, wherein the at least two parts are welded or adhesively bonded to each other.

14. The device as claimed in claim 4, wherein the at least one cavity has a volume of 20 μl to 5 ml.

15. The device as claimed in claim 4, wherein the at least one cavity has a volume of 200 μl to 1 ml.

16. The device as claimed in claim 8, wherein the absorption material is superabsorbent particles or fibers.

17. The device as claimed in claim 9, wherein the filling opening is a funnel-shaped filling nozzle.

18. The device as claimed in claim 1, wherein the at least one cavity is filled with the fluid and emptied of the fluid via the at least one sealing cone.

19. The device as claimed in claim 18, wherein the at least one cavity is filled with the fluid and emptied of the fluid only via the at least one sealing cone.

20. The device as claimed in claim 7, wherein the at least one cavity includes at least one of:

at least one cavity configured to receive reagents as fluid; and at least one cavity in which a sample that is to be analyzed is received as fluid.

* * * * *